US009640313B2

(12) United States Patent
Yazaki

(10) Patent No.: US 9,640,313 B2
(45) Date of Patent: May 2, 2017

(54) MULTILAYER INDUCTOR AND POWER SUPPLY CIRCUIT MODULE

(71) Applicant: MURATA MANUFACTURING CO., LTD., Nagaokakyo-Shi, Kyoto-fu (JP)

(72) Inventor: Hirokazu Yazaki, Nagaokakyo (JP)

(73) Assignee: MURATA MANUFACTURING CO., LTD., Nagaokakyo-Shi, Kyoto-Fu (JP)

( * ) Notice: Subject to any disclaimer, the term of this patent is extended or adjusted under 35 U.S.C. 154(b) by 26 days.

(21) Appl. No.: 14/255,080

(22) Filed: Apr. 17, 2014

(65) Prior Publication Data

US 2014/0225702 A1 Aug. 14, 2014

Related U.S. Application Data

(63) Continuation of application No. PCT/JP2012/076883, filed on Oct. 18, 2012.

(30) Foreign Application Priority Data

Feb. 29, 2012 (JP) ..... 2012-042659

(51) Int. Cl.
*H01F 5/00* (2006.01)
*H01F 27/28* (2006.01)
(Continued)

(52) U.S. Cl.
CPC ..... *H01F 27/2804* (2013.01); *H01F 17/0013* (2013.01); *H01F 27/292* (2013.01); *H01F 17/0033* (2013.01); *H01F 2027/2809* (2013.01)

(58) Field of Classification Search
CPC ..... H01F 17/0013; H01F 17/0006; H01F 27/2804; H01F 17/0033; H01F 2027/2809; H01F 27/292; H01L 23/5227
(Continued)

(56) References Cited

U.S. PATENT DOCUMENTS 6,054,914 A 4/2000 Abel et al.
6,154,114 A * 11/2000 Takahashi ..... 336/200
(Continued)

FOREIGN PATENT DOCUMENTS

JP H11-329845 A 11/1999
JP 2005-167468 A 6/2005
(Continued)

OTHER PUBLICATIONS

Written Opinion and International Search Report issued in PCT/JP2012/076883 mailed on Jan. 22, 2013.

*Primary Examiner* — Elvin G Enad
*Assistant Examiner* — Kazi Hossain
(74) *Attorney, Agent, or Firm* — Arent Fox LLP

(57) ABSTRACT

A multilayer inductor includes a multilayer body formed by stacking magnetic layers on top of one another. Loop-like line-shaped conductors are respectively formed on the magnetic layers. The loop-like line-shaped conductors are connected to one another by interlayer connection conductors, and thereby a coil conductor having an axis extending in the stacking direction is formed. One end of the line-shaped conductor, which is an uppermost-layer-side end portion of the coil conductor, is connected to a line-shaped conductor, which is for routing and is formed on a higher layer, by a interlayer connection conductor. The line-shaped conductor is connected to an interlayer connection conductor that is formed so as to penetrate through substantially the center inside the loop-like line-shaped conductors. The interlayer connection conductor is connected to an external connection conductor on a bottom surface of the multilayer body via a line-shaped conductor and an interlayer connection conductor.

21 Claims, 8 Drawing Sheets

(51) Int. Cl.
*H01F 27/02* (2006.01)
*H01F 27/29* (2006.01)
*H01F 17/00* (2006.01)

(58) Field of Classification Search
USPC ..... 336/200, 83, 192, 232
See application file for complete search history.

(56) References Cited

U.S. PATENT DOCUMENTS 6,189,200 B1 * 2/2001 Takeuchi ..... H01F 17/0013 156/89.12
6,642,809 B2 * 11/2003 Shin ..... H01P 5/185 333/112
8,334,746 B2 12/2012 Matsushita
2002/0153988 A1 * 10/2002 Yazaki et al. ..... 336/229
2002/0157849 A1 * 10/2002 Sakata ..... 174/52.1
2003/0117230 A1 * 6/2003 Shin ..... 333/116
2005/0122699 A1 * 6/2005 Maeda et al. ..... 361/793
2005/0134405 A1 6/2005 Ochi et al.
2007/0069844 A1 * 3/2007 Kudo ..... H01F 17/0013 336/83
2007/0199734 A1 * 8/2007 Kudo et al. ..... 174/255
2009/0134964 A1 * 5/2009 Hebert ..... H01F 17/062 336/200
2009/0153282 A1 * 6/2009 Taoka ..... H01F 17/0013 336/200
2009/0278649 A1 * 11/2009 Tatsukawa ..... H01F 17/0013 336/200
2010/0127812 A1 * 5/2010 Maeda ..... H01F 17/0013 336/200
2010/0328009 A1 12/2010 Tawa
2011/0001599 A1 * 1/2011 Takenaka et al. ..... 336/200
2011/0102124 A1 * 5/2011 Matsushita ..... 336/200
2011/0248811 A1 * 10/2011 Kireev ..... 336/200
2011/0254650 A1 * 10/2011 Banno ..... 336/200
2011/0285494 A1 * 11/2011 Jeong ..... H01F 17/0013 336/200
2012/0056705 A1 * 3/2012 Kim et al. ..... 336/200
2012/0169444 A1 * 7/2012 Son et al. ..... 336/83

FOREIGN PATENT DOCUMENTS

JP 2008-109240 A 5/2008
JP 2010-165964 A 7/2010
WO WO-2010/007858 A1 1/2010

* cited by examiner (A)

(B)

PRIOR ART

PRIOR ART (A)

PRIOR ART (B)

PRIOR ART

MULTILAYER INDUCTOR AND POWER SUPPLY CIRCUIT MODULE

CROSS REFERENCE TO RELATED APPLICATIONS

The present application is a continuation of PCT/JP2012/076883 filed Oct. 18, 2012, which claims priority to Japanese Patent Application No. 2012-042659, filed Feb. 29, 2012, the entire contents of each of which are incorporated herein by reference.

FIELD OF THE INVENTION

The present invention relates to a multilayer inductor including an inductor formed by forming a spiral-shaped conductor in a multilayer body.

BACKGROUND OF THE INVENTION

To date, various surface mount inductors have been proposed in order to form compact power supply circuits. For example, in Patent Document 1, an inductor is disclosed that has an external connection terminal formed at each of the two opposing ends of a rectangular-parallelepiped-shaped multilayer body. An inductor composed of a spiral-shaped conductor is formed inside the multilayer body. One end of the inductor is connected to one of the external connection terminals and the other end of the inductor is connected to the other external connection terminal.

FIG. 9 is an exploded perspective view of a multilayer inductor 100P of the related art described in Patent Document 1. FIG. 10 is a sectional view of the multilayer inductor 100P of the related art. In FIG. 9, illustration of external connection terminals 171P and 172P is omitted. FIG. 10 is a sectional view looking at a plane orthogonal to end surfaces on which the external connection terminals 171P and 172P are formed.

The multilayer inductor 100P includes a rectangular-parallelepiped-shaped multilayer body formed by stacking flat-plate-shaped magnetic layers 101P to 106P in a direction orthogonal to the surfaces of the layers, and the external connection conductors 171P and 172P that are each formed on one of the two ends of the multilayer body located in a direction orthogonal to the stacking direction.

Winding line-shaped conductors 121P, 122P, 123P, 124P and 125P are respectively formed on the five magnetic layers 102P, 103P, 104P, 105P and 106P. The line-shaped conductors 121P, 122P, 123P, 124P and 125P are connected to one another in the stacking direction by interlayer connection conductors 141P, 142P, 143P and 144P. With this configuration, a spiral-shaped inductor having an axis that extends in the stacking direction is formed. One end of the line-shaped conductor 121P, which forms one end of the inductor, is exposed at an end surface of the multilayer body and is connected to the external connection conductor 172P. The other end of the line-shaped conductor 125P, which forms the other end of the inductor, is exposed at the other end surface of the multilayer body and is connected to the external connection conductor 171P.

The external connection conductors 171P and 172P are formed on not only opposing end surfaces of the multilayer body but rather are formed in such a shape as to also extend onto a top surface, a bottom surface and two side surfaces of the multilayer body.

When mounting the multilayer inductor 100P having the above-described form, the external connection terminals 171P and 172P are arranged on and bonded with solder to mounting lands.

Patent Document 1: Japanese Unexamined Patent Application Publication No. 2010-165964

FIG. 11 is a diagram illustrating a mounting configuration of a power supply circuit module including the multilayer inductor 100P of the related art. The power supply circuit module is realized by mounting the multilayer inductor 100P, capacitors 211 and 212 and a switch IC element 201 on a front surface of a base circuit board 200.

Here, in the case of the multilayer inductor 100P, which has the external connection conductors 171P and 172P as described above, in order to secure bonding reliability, as illustrated in FIG. 11, it is necessary for solder fillets to extend over the end, side and bottom surfaces of the external connection conductors 171P and 172P. At this time, the solder sometimes also spreads onto the top surface.

Consequently, as illustrated in FIG. 11, the mounting lands have to be formed so as to extend beyond a region corresponding to the area of the multilayer inductor 100P on the mounting surface, and the area dedicated to mounting of the multilayer inductor 100P is increased.

In addition, the surface of the board 200 on which the individual elements, including the multilayer inductor 100P, are mounted is generally covered with a shield member 220, which realizes electromagnetic shielding. However, since the shield member 220 is composed of a conductive material, top-surface-side portions of the external connection conductors 171P and 172P of the multilayer inductor 100P and solder that has spread onto these top-surface-side portions may come into contact with the shield member 220 and cause short circuit failures to occur. Therefore, the shield member 220 has to be formed and arranged such that a gap Gp, which is of such a size that shorts due to for example variations in the manufacturing process do not occur, is provided between the top surface of the multilayer inductor 100P and a top plate of the shield member 220 and this leads to an increase in the profile of the power supply circuit module.

Consequently, a multilayer inductor 100PP has been considered that has a structure in which the external connection conductors 171P and 172P are not formed on the end surfaces, and in which, as illustrated in FIG. 12, external connection conductors 161PP and 162PP are formed on a bottom surface of the multilayer body. FIG. 12 is an exploded perspective view of the typical LGA type multilayer inductor 100PP.

The multilayer inductor 100PP includes a rectangular-parallelepiped-shaped multilayer body obtained by stacking flat-plate-shaped magnetic layers 101PP to 107PP in a direction orthogonal to the surfaces of the layers.

Winding line-shaped conductors 121PP, 122PP, 123PP, 124PP and 125PP are formed on the five magnetic layers 102PP, 103PP, 104PP, 105PP and 106PP. The line-shaped conductors 121PP, 122PP, 123PP, 124PP and 125PP are connected to one another in the stacking direction by interlayer connection conductors 141PP, 142PP, 143PP and 144PP. With this configuration, a spiral-shaped inductor having an axis that extends in the stacking direction is formed.

One end of the line-shaped conductor 125PP, which is a lowermost-layer-side end portion of the inductor in the stacking direction, is connected to the external connection conductor 161PP on the bottom surface of the multilayer body via an interlayer connection conductor 154PP.

Another end of the line-shaped conductor 121PP, which is an uppermost-layer-side end portion of the inductor in the stacking direction, is connected to a line-shaped conductor 131PP formed on the magnetic layer 102PP, on which the line-shaped conductor 121PP is formed. The line-shaped conductor 131PP is formed in such a shape as to extend toward the inside from the winding line-shaped conductor 121PP.

The line-shaped conductor 131PP is connected to a line-shaped conductor 132PP formed on the magnetic layer 107PP via an interlayer connection conductor 150PP, which penetrates through the magnetic layers 102PP, 103PP, 104PP, 105PP and 106PP. The line-shaped conductor 132PP is connected to the external connection conductor 162PP on the bottom surface of the multilayer body via an interlayer connection conductor 153PP.

Since the mounting lands are below the bottom surface of the multilayer inductor 100PP as a result of using the LGA type multilayer inductor 100PP having the external connection conductors 161PP and 162PP formed on the bottom surface in this way, the area dedicated to mounting can be reduced. In addition, the top surface of the multilayer inductor 100PP has an insulation property and therefore even if it contacts the shield member there is no problem and it is possible to reduce the profile of the power supply circuit module.

However, there is the following problem with the LGA type multilayer inductor 100PP having the structure illustrated in FIG. 12. FIG. 13 shows diagrams for explaining a problem in a case where the typical LGA type multilayer inductor 100PP is used. FIG. 13(A) is a sectional view taken along cross section A-A' in FIG. 12. FIG. 13(B) is a sectional view taken along cross section B-B' in FIG. 12.

In the typical LGA type multilayer inductor 100PP, the line-shaped conductor 131PP, which is for routing the uppermost-layer end portion of the inductor to the external connection conductor 162PP on the bottom surface of the multilayer body, is on the same layer as the line-shaped conductor 121PP of the inductor of the multilayer inductor 100PP, and therefore, as illustrated in FIG. 13(A), the line-shaped conductor 131PP disturbs formation of magnetic flux by the inductor composed of the line-shaped conductors 121PP to 125PP. As a result of this, various characteristics of the inductor are degraded.

SUMMARY OF THE INVENTION

Therefore, an object of the present invention is to provide a multilayer inductor that has excellent characteristics.

A multilayer inductor of the present invention includes a multilayer body formed by stacking a plurality of substrate layers on top of one another, a first external connection conductor and a second external connection conductor formed on a bottom surface of the multilayer body, a coil conductor that includes loop-like line-shaped conductors formed on the plurality of substrate layers and an interlayer connection conductor that connect the line-shaped conductors of the substrate layers to each other in the stacking direction, the coil conductor being formed in a spiral shape having an axis that extends in a stacking direction, a first connection conductor that connects an uppermost-layer-side end portion of the coil conductor to the first external connection conductor and a second connection conductor that connects a lowermost-layer-side end portion of the coil conductor to the second external connection conductor.

The first connection conductor includes a first interlayer connection conductor, a routing conductor and a second interlayer connection conductor. The first interlayer connection conductor is formed so as to be connected to a loop-like line-shaped conductor of an uppermost layer of the coil conductor and is routed to a higher layer than the uppermost layer of the coil conductor inside the multilayer body. The routing conductor is connected to the first interlayer connection conductor and is formed on the higher layer than the uppermost layer of the coil conductor. The second interlayer connection conductor is formed so as to connect the routing conductor to the first external connection conductor.

With this configuration, the routing conductor, which is for connecting the uppermost-layer-side end portion of the coil conductor to the first external connection conductor formed on the bottom surface of the multilayer body, is separated from the coil conductor. Thus, disturbance of formation of magnetic flux by the coil conductor can be suppressed.

In addition, in the multilayer inductor of the present invention, it is preferable that a distance between the loop-like line-shaped conductor of the uppermost layer and the routing conductor in the stacking direction be greater than a distance between an outer peripheral edge of the loop-like line-shaped conductors and a side surface of the multilayer body.

With this configuration, the influence of the routing conductor on the formation of the magnetic flux by the coil conductor can be suppressed with more certainty.

In addition, it is preferable that the second interlayer connection conductor of the multilayer inductor of the present invention penetrate in the stacking direction inside the loop-like line-shaped conductors of the coil conductor.

With this configuration, the loop-like line-shaped conductors can be effectively formed by using the entire surfaces of the substrate layers. That is, a larger inductance can be obtained than with a small area.

In addition, it is preferable that the multilayer inductor of the present invention have the following configuration. The first connection conductor includes a lower layer routing conductor, which connects the second interlayer connection conductor to the first external connection conductor, on a lower layer than a lowermost substrate layer on which a loop-like line-shaped conductor is formed. A distance between the loop-like line-shaped conductor of the lowermost layer and the lower layer routing conductor in the stacking direction is greater than a distance between an outer peripheral edge of the loop-like line-shaped conductors and a side surface of the multilayer body.

With this configuration, also in the case where the lower layer routing conductor is formed below the coil conductor, the influence of the lower layer routing conductor on formation of magnetic flux by the coil conductor can be suppressed.

In addition, it is preferable that the multilayer inductor of the present invention have the following configuration. A dummy pattern is formed in a region inside the loop-like line-shaped conductor, when the multilayer body is viewed in the stacking direction, on a higher layer than the routing conductor in the multilayer body.

With this configuration, the occurrence of a depression in an area inside the loop-like line-shaped conductors when the multilayer body is fired can be prevented. Thus, a multilayer inductor having top and bottom surfaces with a high degree of flatness can be realized.

In addition, a DC-DC converter of the present invention includes the above-described multilayer inductor, the substrate layer of the multilayer inductor being a magnetic layer and the multilayer inductor being used as a converter inductor.

With this configuration, by using the above-described multilayer inductor, a power supply circuit module can be formed using an inductor that has excellent direct current superposition characteristics. Thus, a power supply circuit module that has the same shape but can draw a larger current can be realized.

According to the present invention, a multilayer inductor having excellent characteristics can be realized.

DETAILED DESCRIPTION OF THE PREFERRED EMBODIMENTS

Figure 1:
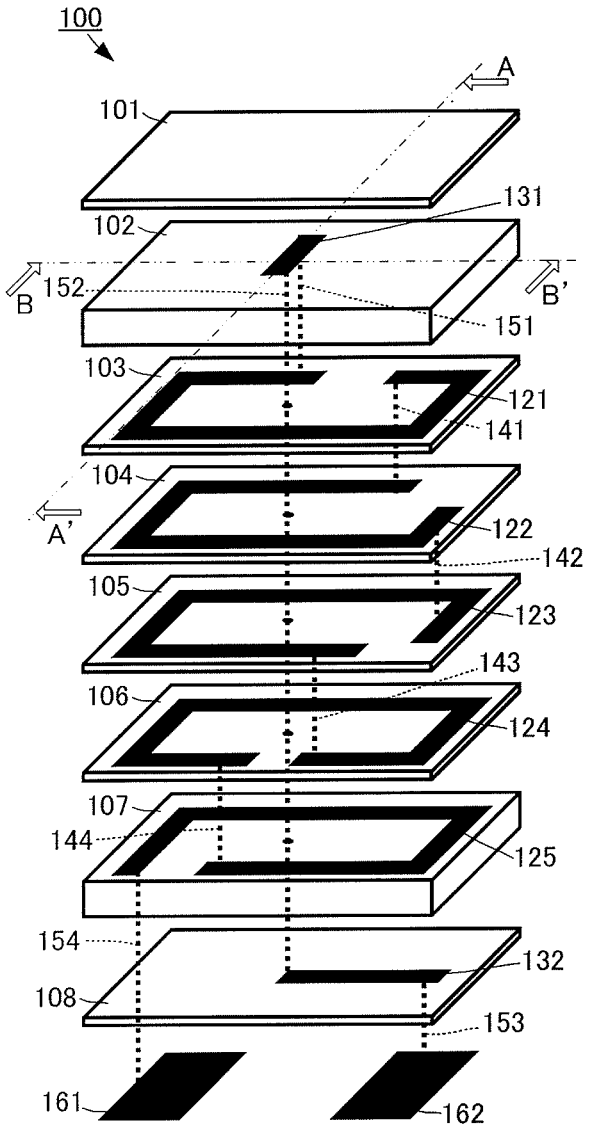
FIG. 1 is an exploded perspective view of a multilayer inductor 100 according to a first embodiment of the present invention.

A multilayer inductor according to a first embodiment of the present invention will now be described with reference to the drawings. FIG. 1 is an exploded perspective view of a multilayer inductor 100 according to the first embodiment of the present invention. FIG. 2(A) is a sectional view taken along a cross section A-A' in FIG. 1 for the multilayer inductor 100 according to the first embodiment of the present invention. FIG. 2(B) is a sectional view taken along a cross section B-B' in FIG. 1 for the multilayer inductor 100 according to the first embodiment of the present invention.

The multilayer inductor 100 is a so-called land grid array (LGA) type inductor and includes a multilayer body, inside of which a coil conductor is formed, and external connection conductors 161 and 162 formed on a bottom surface of the multilayer body.

The external connection conductors 161 and 162 are rectangular flat plate conductors having a certain area. The external connection conductor 161 is formed in the vicinity of a first end surface of the multilayer body. The external connection conductor 162 is formed in the vicinity of a second end surface (surface opposite to the first end surface) of the multilayer body.

The multilayer body is composed of a plurality (eight in this embodiment) of magnetic layers 101, 102, 103, 104, 105, 106, 107 and 108. The number of layers is not limited to this and can be appropriately set in accordance with the specification.

The eight magnetic layers 101 to 108 are stacked in this order in a direction orthogonal to their surfaces such that the magnetic layer 101 is an uppermost layer, the magnetic layer 108 is a lowermost layer and their surfaces are parallel to one another.

(Structure of Coil Conductor)

Loop-like line-shaped conductors 121, 122, 123, 124 and 125 are respectively formed on the magnetic layers 103 to 107. These line-shaped conductors 121, 122, 123, 124 and 125 are formed so as to form a single spiral having an axis that extends in the stacking direction via interlayer connection conductors 141, 142, 143 and 144. A coil conductor having an axis that extends in the stacking direction is formed by the loop-like line-shaped conductors 121, 122, 123, 124 and 125 and the interlayer connection conductors 141, 142, 143 and 144.

The structure of the magnetic layers 103 to 107 will now be more specifically described.

The loop-like line-shaped conductor 121 is formed on the top surface side of the magnetic layer 103. The line-shaped conductor 121 is formed so as to extend along an outer peripheral edge of the magnetic layer 103 such that there is a gap of width G1 between the line-shaped conductor 121 and the outer peripheral edge. One end of the line-shaped conductor 121 (corresponding to "the uppermost-layer-side end portion of the coil conductor".) is connected to a lower end of an interlayer connection conductor 151, which penetrates through the insulator layer 102. This interlayer connection conductor 151 corresponds to a "first interlayer connection conductor" of the present invention. The other end of the line-shaped conductor 121 is connected to an upper end of the interlayer connection conductor 141, which penetrates through the insulator layer 103.

The loop-like line-shaped conductor 122 is formed on the top surface side of the magnetic layer 104. The line-shaped conductor 122 is formed so as to extend along an outer peripheral edge of the magnetic layer 104 such that there is a gap of width G1 between the line-shaped conductor 122 and the outer peripheral edge. One end of the line-shaped conductor 122 is connected to a lower end of the interlayer connection conductor 141, which penetrates through the insulator layer 103. The other end of the line-shaped conductor 122 is connected to an upper end of the interlayer connection conductor 142, which penetrates through the insulator layer 104.

The loop-like line-shaped conductor 123 is formed on the top surface side of the magnetic layer 105. The line-shaped conductor 123 is formed so as to extend along an outer peripheral edge of the magnetic layer 105 such that there is a gap of width G1 between the line-shaped conductor 123 and the outer peripheral edge. One end of the line-shaped conductor 123 is connected to a lower end of the interlayer connection conductor 142, which penetrates through the insulator layer 104. The other end of the line-shaped conductor 123 is connected to an upper end of the interlayer connection conductor 143, which penetrates through the insulator layer 105.

The loop-like line-shaped conductor 124 is formed on the top surface side of the magnetic layer 106. The line-shaped conductor 124 is formed so as to extend along an outer peripheral edge of the magnetic layer 106 such that there is a gap of width G1 between the line-shaped conductor 124 and the outer peripheral edge. One end of the line-shaped conductor 124 is connected to a lower end of the interlayer connection conductor 143, which penetrates through the insulator layer 105. The other end of the line-shaped conductor 124 is connected to an upper end of the interlayer connection conductor 144, which penetrates through the insulator layer 106.

The loop-like line-shaped conductor 125 is formed on the top surface side of the magnetic layer 107. The line-shaped conductor 125 is formed so as to extend along an outer peripheral edge of the magnetic layer 107 such that there is a gap of width G1 between the line-shaped conductor 125 and the outer peripheral edge. One end of the line-shaped conductor 125 is connected to a lower end of the interlayer connection conductor 144, which penetrates through the insulator layer 106.

The other end of the line-shaped conductor 125 (corresponding to "the lowermost-layer-side end portion of the coil conductor".) is connected to an upper end of an interlayer connection conductor 154, which penetrates through the insulator layers 107 and 108. A lower end of the interlayer connection conductor 154 is connected to the external connection conductor 161 on the bottom surface of the multilayer body (bottom surface of magnetic layer 108). This interlayer connection conductor 154 corresponds to a "second connection conductor" of the present invention.

(Structures Other than Coil Conductor)

Conductors are not formed on the magnetic layer 101 and the magnetic layer 101 forms the top surface layer of the multilayer body.

A line-shaped conductor 131 for routing is formed on the magnetic layer 102. This line-shaped conductor 131 corresponds to a "routing conductor" of the present invention. One end of the line-shaped conductor 131 of the magnetic layer 102 is connected to one end (corresponding to "the uppermost-layer-side end portion of the coil conductor".) of the line-shaped conductor 121 via the interlayer connection conductor 151, which penetrates through the magnetic layer 102. This interlayer connection conductor 151 corresponds to a "first interlayer connection conductor" of the present invention. Thus, since the one end of the line-shaped conductor 131 is to be connected to the line-shaped conductor 121 via the interlayer connection conductor 151, the one end of the line-shaped conductor 131 is arranged in the vicinity of the outer periphery of the magnetic layer 102.

The line-shaped conductor 131 is formed in such a shape as to extend from the vicinity of the outer periphery of the magnetic layer 102 toward the center of the magnetic layer 102 and the other end of the line-shaped conductor 131 is positioned substantially in the center when the magnetic layer 102 is viewed in plan (looking in the stacking direction).

The other end of the line-shaped conductor 131 is connected to an upper end of an interlayer connection conductor 152, which penetrates through the magnetic layers 101, 102, 103, 104, 105, 106 and 107. The interlayer connection conductor 152 is formed substantially in the center when each magnetic layer, that is, the multilayer body, is viewed in plan. A lower end of the interlayer connection conductor 152 is connected to one end of a line-shaped conductor 132, which is formed on the top surface side of the magnetic layer 108. This interlayer connection conductor 152 corresponds to a "second interlayer connection conductor" of the present invention.

The line-shaped conductor 132, which is for routing, is formed on the top surface side of the magnetic layer 108. One end of the line-shaped conductor 132 is positioned substantially in the center when the magnetic layer 108 is viewed in plan and is connected to the lower end of the interlayer connection conductor 152. The line-shaped conductor 132 is shaped so as to extend from substantially the center of the magnetic layer 108 to an edge portion side at which the external connection conductor 162 is formed when the multilayer body is viewed in plan. The other end of the line-shaped conductor 132 is arranged at a position that is superposed with an area in which the external connection conductor 162 is formed when the multilayer body is viewed in plan. This line-shaped conductor 132 corresponds to a "lower layer routing conductor" of the present invention.

The other end of the line-shaped conductor 132 is connected to an upper end of an interlayer connection conductor 153, which penetrates through the magnetic layer 108. A lower end of the interlayer connection conductor 153 is connected to the external connection conductor 162. A "first connection conductor" of the present invention is formed of the interlayer connection conductor 151, which corresponds to the "first interlayer connection conductor", the line-shaped conductor 131, which corresponds to the "routing conductor", the interlayer connection conductor 152, which corresponds to the "second interlayer connection conductor", the line-shaped conductor 132, which corresponds to the "lower layer routing conductor", and the interlayer connection conductor 153.

With the above-described configuration, the line-shaped conductor 131 for routing, which is for connecting the one end of the line-shaped conductor 121, which is an uppermost-layer-side end portion of the coil conductor, to the external connection conductor 162 of the bottom surface of the multilayer body, is formed further toward the outside, which is spaced apart from the line-shaped conductor 121, than the coil conductor. Thus, as illustrated in FIG. 2(A), the line-shaped conductor 131 is substantially not coupled with a magnetic field created by the coil conductor and disturbance of formation the magnetic flux by the coil conductor due to the line-shaped conductor 131 can be suppressed. Thus, various characteristics of the inductor can be improved.

In particular, as illustrated in FIG. 2(A), a distance between the line-shaped conductor 121, which is in the uppermost layer of the coil conductor, and the line-shaped conductor 131 in the stacking direction is T1. In addition, a distance between the outer peripheral edge (edge surface) of the multilayer body and the outer peripheral edge of the group of loop-like line-shaped conductors (coil conductor) is G1. The thickness of the magnetic layer 102 is adjusted such that T1>G1.

With this configuration, the line-shaped conductor 131 is even less coupled with the magnetic field produced by the coil conductor. Thus, disturbance of formation of magnetic flux by the coil conductor due to the line-shaped conductor 131 can be further suppressed and various characteristics of the inductor can be further improved.

In addition, further, as illustrated in FIG. 2(A), a distance between the line-shaped conductor 125, which is in the lowermost layer of the coil conductor, and the line-shaped conductor 132 in the stacking direction is T2. The thickness of the magnetic layer 107 is adjusted such that T2>G1.

With this configuration, the line-shaped conductor 132 is not coupled with the magnetic field produced by the coil conductor. Thus, disturbance of the formation of magnetic flux by the coil conductor due to the line-shaped conductor 132 can be suppressed and various characteristics of the inductor can be further improved.

Figure 3:
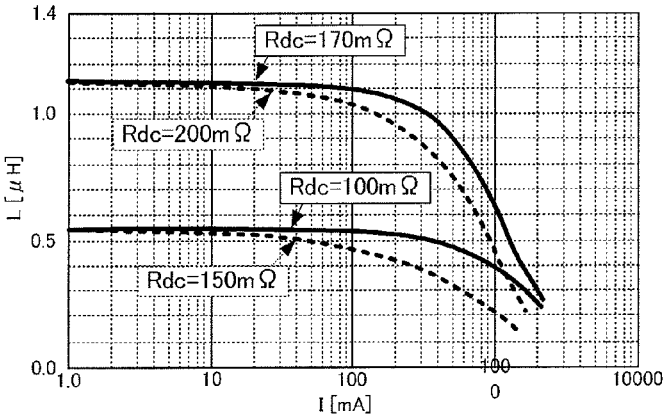
FIG. 3 illustrates direct current superposition characteristics of the multilayer inductor 100 having the configuration of this embodiment and of a typical LGA type multilayer inductor 100PP illustrated in the above-mentioned FIG. 12.
Figure 4:
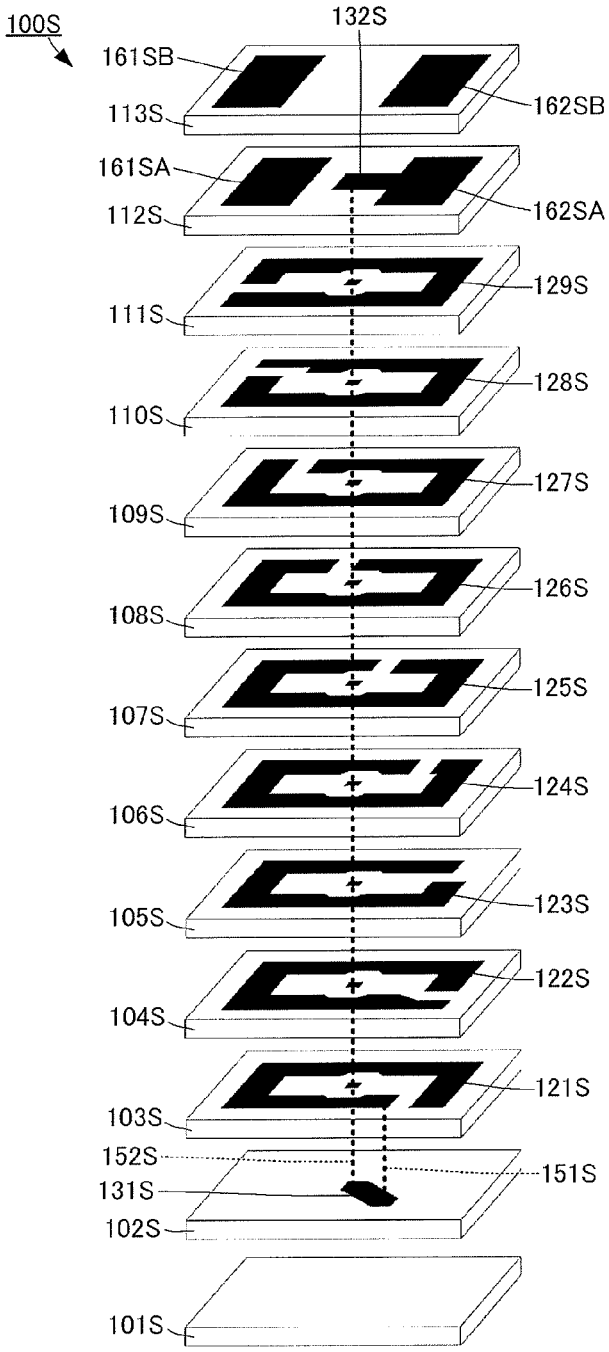
FIG. 4 is an exploded perspective view of a multilayer inductor used in a simulation.
Figure 12:
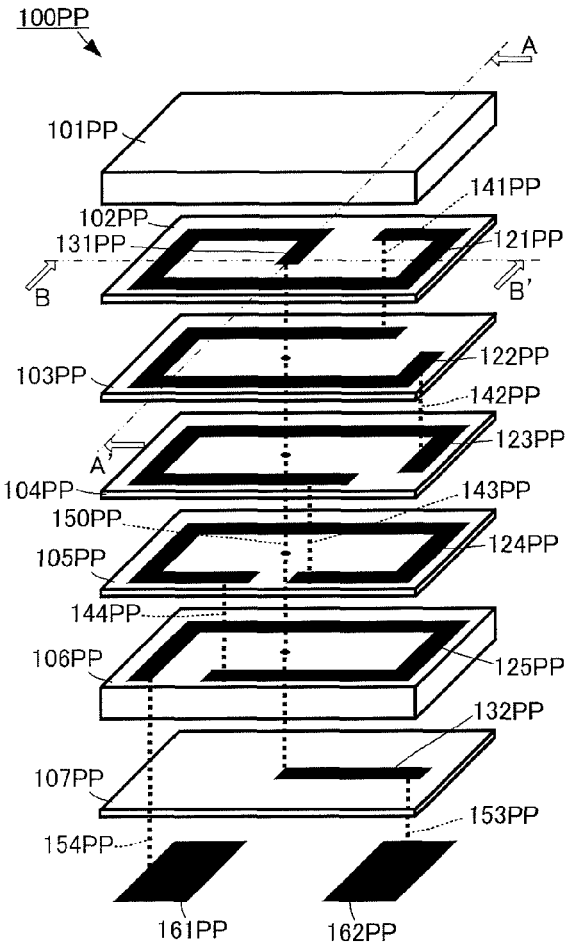
FIG. 12 is an exploded perspective view of a typical LGA type multilayer inductor 100PP.

FIG. 3 illustrates direct current superposition characteristics of the multilayer inductor 100 having the configuration of this embodiment and of the typical LGA type multilayer inductor 100PP illustrated in the above-mentioned FIG. 12. In this figure, solid lines represent the results for this embodiment and broken lines represent the results for the structure of FIG. 12. This simulation is performed using the structure illustrated in FIG. 4. FIG. 4 is an exploded perspective view of a multilayer inductor used in the simulation. The multilayer inductor of FIG. 4 employs a coil conductor composed of nine layers of loop-like conductors and the outer shape (planar shape) of the multilayer body thereof is 2.0 mm×1.25 mm.

From FIG. 3, it is clear that the inductance remains unchanged up to a larger load current when using the configuration of this embodiment than when using the structure of FIG. 12. In addition, the same inductance can be realized using a lower Rdc. Thus, by using the configuration of this embodiment, direct current superposition characteristics can be improved.

Figure 2:
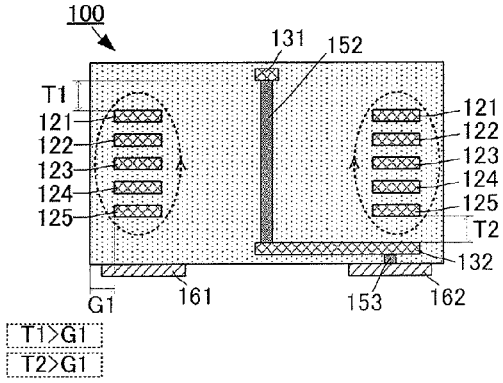
FIG. 2 shows a sectional view taken along the cross section A-A' of FIG. 1 and a sectional view taken along cross section B-B' of FIG. 1 for the multilayer inductor 100 according to the first embodiment of the present invention.
Figure 2:
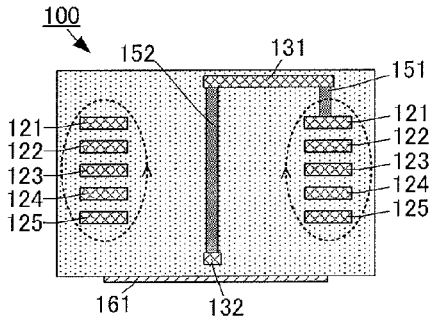
Figure 10:
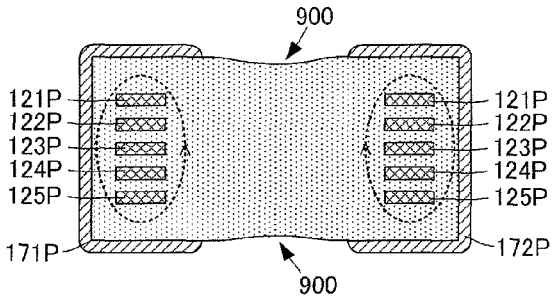
FIG. 10 is a sectional view of the multilayer inductor 100P of the related art.
Figure 13:
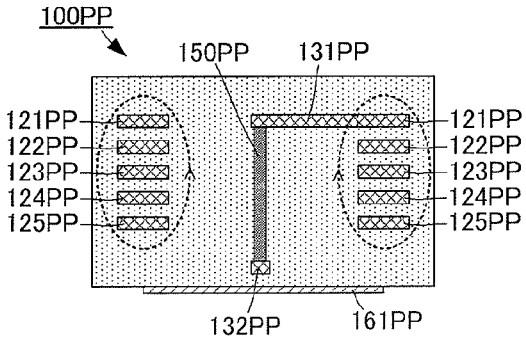
FIG. 13 shows diagrams for explaining a problem in a case where the typical LGA type multilayer inductor 100PP is used.
Figure 13:
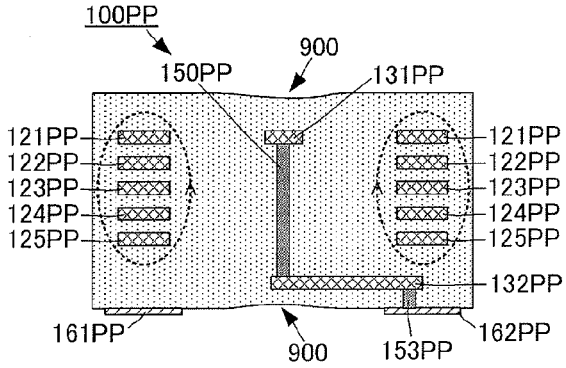

In addition, by using the configuration of this embodiment, the following advantage in terms of design can be obtained. As illustrated in FIG. 2, in the configuration of this embodiment, an interlayer connection conductor, which has a height larger than the layer thickness of the group of magnetic layers in which the coil conductor is formed, is formed inside the group of loop-like line-shaped conductors, that is, inside the coil conductor. Thus, sinking of the inside of the group of loop-like line-shaped conductors as in the multilayer inductor 100P of the related art illustrated in FIG. 10 and the LGA type multilayer inductor 100PP which can be typically assumed to have the configuration illustrated in FIG. 12 and FIG. 13(B) that occurs when the multilayer body is fired, can be suppressed in the multilayer inductor 100 of this embodiment. Thus, improvements can be made such that abnormalities do not occur at the time of mounting.

Figure 5:
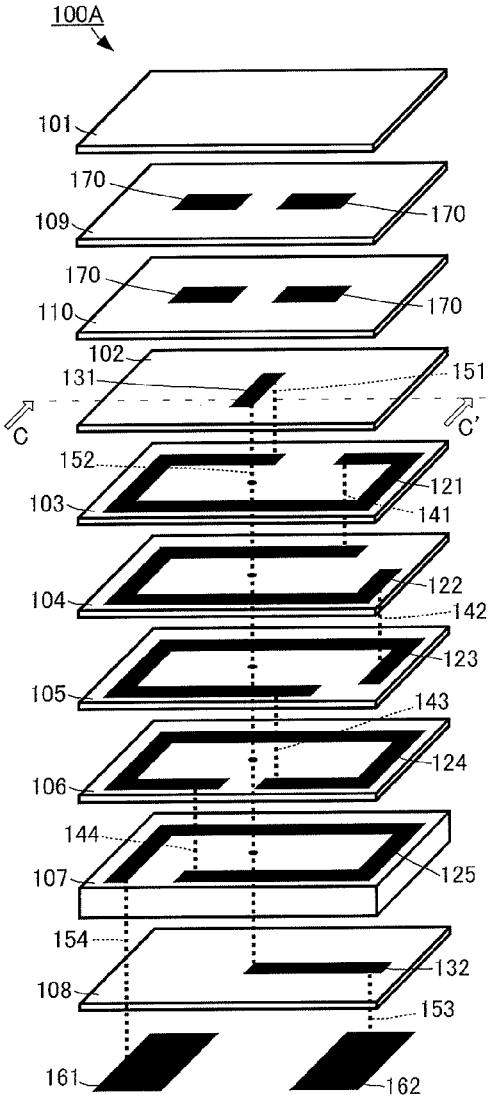
FIG. 5 is an exploded perspective view of a multilayer inductor 100A according to a second embodiment of the present invention.
Figure 6:
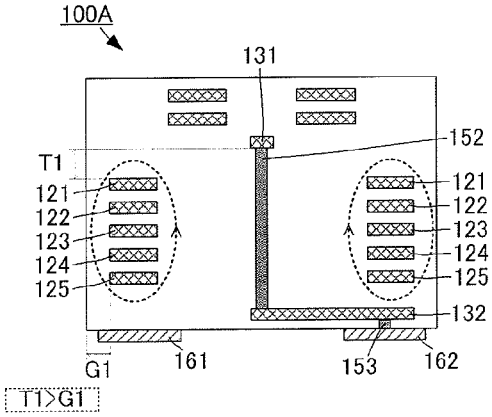
FIG. 6 is a sectional view taken along a cross section C-C' in FIG. 5 for the multilayer inductor 100A according to the second embodiment of the present invention.

Next, a multilayer inductor according to a second embodiment will be described with reference to the drawings. FIG. 5 is an exploded perspective view of a multilayer inductor 100A according to the second embodiment of the present invention. FIG. 6 is a sectional view taken along a cross section C-C' in FIG. 5 for the multilayer inductor 100A according to the second embodiment of the present invention.

The multilayer inductor 100A of this embodiment is obtained by adding layers on which dummy patterns have been formed to the multilayer inductor 100 of the first embodiment. The rest of the configuration is the same. Therefore only points of difference will be described.

Magnetic layers 109 and 110 are provided between the magnetic layer 101 and the magnetic layer 102. Dummy patterns 170 are formed on the magnetic layers 109 and 110. The dummy patterns 170 are each formed in such a shape as to not be superposed with the group of loop-like line-shaped conductors 121 to 125, which form the coil conductor, and the routing conductor 131 when the multilayer body is viewed in plan.

By forming the dummy patterns 170, the density with which conductors are formed inside the group of loop-like line-shaped conductors when the multilayer body is viewed in plan can be increased. Thus, caving in of the inside of the group of loop-like line-shaped conductors can be suppressed with more certainty and a multilayer inductor that has a higher degree of flatness can be formed.

At this time, the dummy patterns 170 are formed on higher layers than the routing conductor 131 and therefore the dummy patterns 170 do not disturb formation of magnetic flux by the coil conductor. Therefore, a multilayer inductor can be formed that has various excellent characteristics and has a high degree of flatness.

Figure 7:
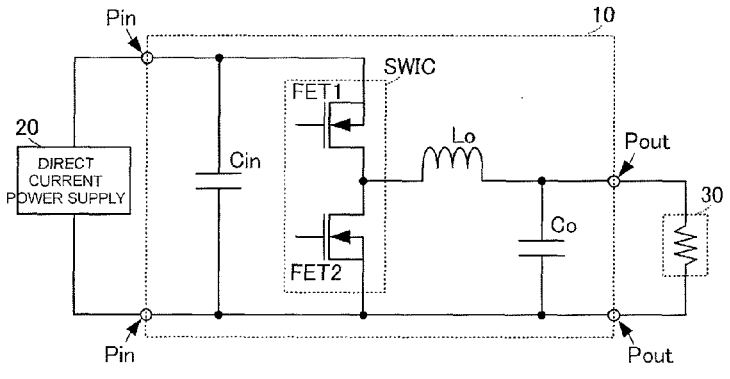
FIG. 7 is a circuit diagram of a power supply circuit module.
Figure 8:
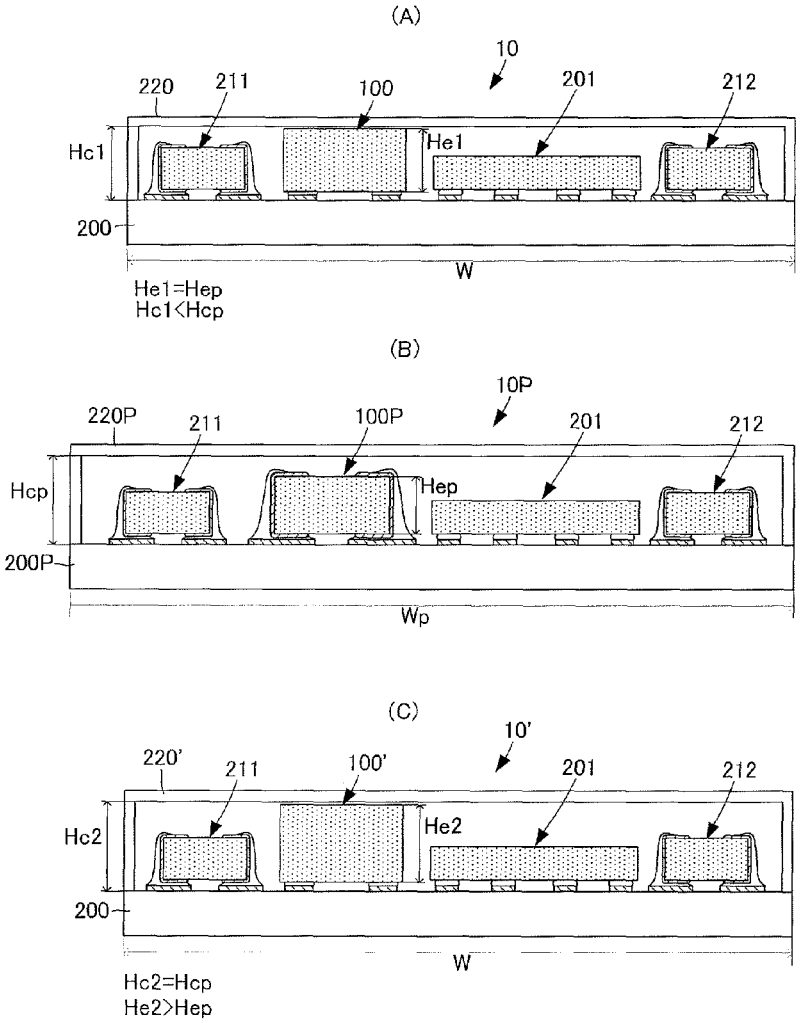
FIG. 8 shows side views of the outline configuration of a power supply circuit module.
Figure 9:
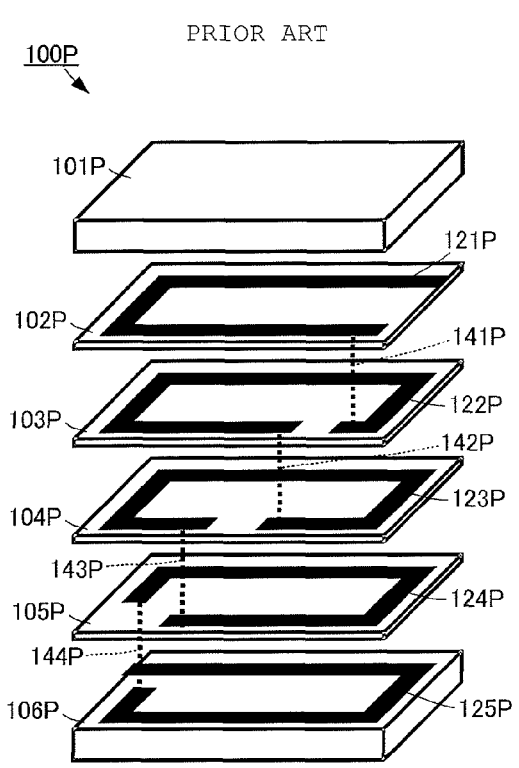
FIG. 9 is an exploded perspective view of a multilayer inductor 100P of the related art described in Patent Document 1.

Next, a power supply circuit module that employs one of these multilayer inductors will be described with reference to the drawings. FIG. 7 is a circuit diagram of a power supply circuit module. FIG. 8 shows side views of an outline configuration of a power supply circuit module. FIGS. 8(A) and 8(C) illustrate a case in which a multilayer inductor of any of the above-described embodiments is used and FIG. 8(B) illustrates a case in which the multilayer inductor having external connection conductors on side surfaces thereof of the related art is used for comparison.

A power supply circuit module 10 includes an input capacitor Cin, a switch element SWIC, an inductor Lo and an output capacitor Co. The input capacitor Cin is connected between a pair of input terminals Pin of the power supply circuit module 10. The switch element SWIC is connected to the input capacitor Cin. The switch element SWIC includes a high-side FET 1 and a low-side FET 2. A series circuit formed of the inductor Lo and the output capacitor Co is connected to the FET 2. The two ends of the output capacitor Co serve as a pair of output terminals Pout. A direct current power supply 20 is connected to the input terminals Pin and a load 30 is connected to the output terminals Pout.

The power supply circuit module 10 receives power supply from the direct current power supply 20, performs on/off control on the FET 1 and FET 2 of the switch element SWIC, and thereby functions as a step down converter and supplies a stepped down direct current voltage to the load 30.

The above-described multilayer inductor 100 or 100A is employed as the inductor Lo in the power supply circuit module 10 having this circuit configuration.

As described above, the multilayer inductors 100 and 100A having the configurations of the present invention have excellent direct current superposition characteristics and therefore, by using the multilayer inductor 100 or 100A, a power supply circuit module 10 that draws a larger amount of current but has the same shape can be realized.

The power supply circuit module 10 having this circuit configuration is realized with the structure illustrated in FIG. 8(A).

As illustrated in FIG. 8(A), the power supply circuit module 10 includes a base circuit board 200, the multilayer inductor 100, capacitors 211 and 212, a switch IC element 201 and a shield member 220.

A wiring pattern, the input terminals Pin, and the output terminals Pout of the power supply circuit module 10 illustrated in FIG. 7 are formed on the base circuit board 200. The multilayer inductor 100, the capacitors 211 and 212, and the switch IC element 201 are mounted on one main surface of the base circuit board 200. The conductive shield member 220 is arranged on the one main surface side of the base circuit board 200 so as to cover the multilayer inductor 100, the capacitors 211 and 212, and the switch IC element 201.

Figure 11:
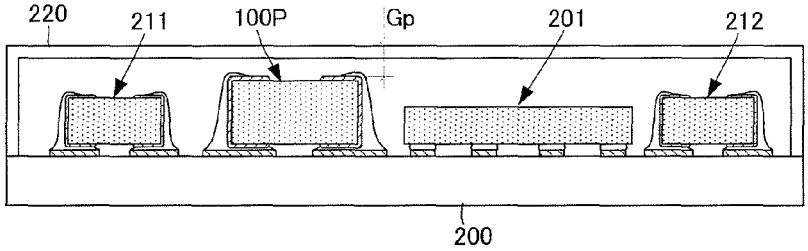
FIG. 11 is a diagram illustrating a mounting configuration of a power supply circuit module including the multilayer inductor 100P of the related art.

As a result of using the multilayer inductor 100 of this embodiment, mounting lands for the multilayer inductor 100 lie within an area in which the multilayer inductor 100 is arranged when the base circuit board 200 is viewed in plan (looking from a direction orthogonal to the one main surface). Therefore, the area dedicated to mounting the multilayer inductor 100 is not widened due to the mounting lands. Thus, for example, if the spaces between individual elements are the same, the planar area can be reduced in the power supply circuit module 10 of this embodiment compared with a power supply circuit module 10P of the related art illustrated in FIG. 8(B), which is the same as FIG. 11. In the example of FIG. 8, a length W of the power supply circuit module 10 illustrated in FIG. 8(A) can be made shorter than a length Wp of the power supply circuit module 10P illustrated in FIG. 8(B) (W<Wp). As a result, even with the same element configuration, a more compact power supply circuit module can be realized.

In addition, in the case of the configuration of this embodiment, a surface of a top plate of the shield member 220 on the base circuit board 200 side (ceiling surface), and a top surface of the multilayer inductor 100 can be brought close to each other to the degree that they are substantially in contact with each other. Thus, the power supply circuit module 10 of this embodiment can be made to have a lower profile than the power supply circuit module 10P of the related art illustrated in FIG. 8(B). In the example of FIG. 8, a height Hc1 from the base circuit board 200 to the shield member 220 in the power supply circuit module 10 illustrated in FIG. 8(A) can be made lower than a height Hcp from the base circuit board 200 to the shield member 220P in the power supply circuit module 10P of the related art illustrated in FIG. 8(B) (Hc1<Hcp).

Therefore, even if a mount height He1 of the multilayer inductor 100 illustrated in FIG. 8(A) is the same as a mount height Hep of the multilayer inductor 100P illustrated in FIG. 8(B), a power supply circuit module having a lower profile can be realized. In addition, with the configuration of this embodiment, even if there is an error at the time of mounting, there will not be a short circuit between the multilayer inductor 100 and the shield member 220.

In addition, FIG. 8(C) illustrates a power supply circuit module 10' in which a height Hc2 from the base circuit board 200 to the shield member 220' is the same as the height Hcp from the base circuit board 200 to the shield member 220P in the power supply circuit module 10P of the related art illustrated in FIG. 8(B) and to which the configuration of this embodiment has been applied. In the case in which this configuration is adopted, the element height of the multilayer inductor 100' can be made higher. Thus, the number of loop-like line-shaped conductors formed can be increased. That is, the number of turns of the coil conductor can be increased. Thus, for a module of the same height, an inductor having a higher inductance value can be used.

In each of the above-described embodiments of a multilayer inductor, a case was described in which each substrate layer making up the multilayer body is a magnetic layer (magnetic ceramic layer). However, the layers may instead each be a non-magnetic layer (magnetic ceramic layer having a low magnetic permeability or dielectric ceramic layer). Furthermore, a composite body made up of magnetic layers and nonmagnetic layers may be used. In addition, it is preferable that ceramic layers be used so that magnetic layers having a high magnetic permeability can be formed, but resin layers including a magnetic or dielectric filler may also be used. In addition, it is preferable that copper or a low resistivity conductive material having for example copper as a main component be used for each line-shaped conductor, external connection conductor and interlayer connection conductor.

In addition, in the above descriptions, an example was described in which the interlayer connection conductor 152, which connects an uppermost-layer-side end portion of the coil conductor to an external connection conductor on the bottom surface of the multilayer body, is arranged substantially in the center inside the group of loop-like line-shaped conductors. However, part of the group of loop-like line-shaped conductors may be formed on an inner side in the magnetic layers and that interlayer connection conductor may be arranged outside of the group of loop-like line-shaped conductors. In this case, if the interlayer connection conductor is provided at a position that is superposed with the external connection conductor when the multilayer body is viewed in plan, the lower layer routing conductor can be omitted.

In addition, in the above descriptions, an example was described in which the coil conductor is formed of loop-like conductors that extend through less than a complete turn, but the loop-like conductors may instead extend through a plurality of turns.

In addition, a multilayer inductor of the present invention may include a capacitor pattern or a wiring line pattern thereinside in addition to the inductor pattern.

In addition, in the above descriptions, a step down converter was described as an example, but the above-described multilayer inductors can be also used in other DC-DC converters and a similar operational effect as for the above-described power supply circuit module 10, which is a step down converter, can be obtained.

REFERENCE SIGNS LIST

10, 10', 10P: power supply circuit module,
100, 100A, 100P, 100', 100PP: multilayer inductor,
101, 102, 103, 104, 105, 106, 107, 108, 109, 110, 101P, 102P, 103P, 104P, 105P, 106P, 101PP, 102PP, 103PP, 104PP, 105PP, 106PP, 107PP: magnetic layer,
121, 122, 123, 124, 125, 121P, 122P, 123P, 124P, 125P, 121PP, 122PP, 123PP, 124PP, 125PP, 131, 132, 131PP, 132PP: line-shaped conductor,
141, 142, 143, 144, 141P, 142P, 143P, 144P, 141PP, 142PP, 143PP, 144PP, 151, 152, 153, 154, 150PP, 153PP, 154PP: interlayer connection conductor,
161, 162, 161PP, 162PP, 171P, 172P: external connection conductor,
170: dummy pattern,
200: base circuit board,
201: switch IC element,
211, 212: capacitor,
220, 220', 220P: shield member,
900: depression

The invention claimed is:

1. A multilayer inductor comprising:

a multilayer body having a top and a bottom surface and a plurality of stacked substrate layers disposed therebetween;

a first external connection conductor and a second external connection conductor each disposed on the bottom surface of the multilayer body;

a coil conductor that includes a plurality of loop-like line-shaped conductors each disposed on one of the plurality of stacked substrate layers and a plurality of interlayer conductors that connect the loop-like line-shaped conductors to each other, respectively;

a first connection conductor that electrically connects a first end portion of the coil conductor to the first external connection conductor; and a second connection conductor that electrically connects a second end portion of the coil conductor to the second external connection conductor, wherein the first connection conductor includes a first single linear routing conductor disposed on a substrate layer between the coil conductor and a top surface of the multilayer body, a first interlayer conductor that connects the first routing conductor to a loop-like line-shaped conductor of an uppermost layer of the coil conductor, and a second interlayer conductor that connects the first single linear routing conductor to the first external connection conductor, wherein the substrate layer between the coil conductor and the first linear routing conductor has a thickness greater than a thickness of the substrate layer between two adjacent loop-like line-shaped conductors of the coil conductor.

2. The multilayer inductor according to claim 1, wherein the coil conductor comprises a spiral shape with an axis that extends in a direction orthogonal to the stacked substrate layers.

3. The multilayer inductor according to claim 1, wherein the second interlayer conductor that connects the first single linear routing conductor to the first external connection conductor extends through the plurality of stacked substrate layers and is not directly connected to the plurality of loop-like line-shaped conductors disposed on the plurality of stacked substrate layers, respectively.

4. The multilayer inductor according to claim 1, wherein a distance between the loop-like line-shaped conductor of the uppermost layer of the coil conductor and the first single linear routing conductor is greater than a distance between an outer peripheral edge of the coil conductor and a side surface of the multilayer body.

5. The multilayer inductor according to claim 1, wherein the second interlayer conductor is disposed in a direction orthogonal to the stacked substrate layers and inside the loop-like line-shaped conductors of the coil conductor.

6. The multilayer inductor according to claim 1, wherein the first connection conductor further comprises a second linear routing conductor disposed on one of the plurality of stacked substrate layers that is between the coil conductor and the bottom surface of the multilayer body, wherein the second linear routing conductor electrically connects the second interlayer conductor to the first external connection conductor.

7. The multilayer inductor according to claim 6, wherein a distance between the coil conductor and the second linear routing conductor is greater than a distance between an outer peripheral edge of the coil conductor and a side surface of the multilayer body.

8. The multilayer inductor according to claim 2, wherein at least one of the plurality of stacked substrate layers disposed between the coil conductor and the top surface of the multilayer body comprises a dummy pattern formed in a region inside the loop-like line-shaped conductor, when the multilayer body is viewed in a direction orthogonal to the plurality of stacked substrate layers.

9. A power supply circuit module comprising the multilayer inductor according to claim 1, wherein the plurality of stacked substrate layers are magnetic layers and the multilayer inductor is configured to operate as a converter inductor.

10. A multilayer inductor comprising:

a multilayer body having a plurality of stacked substrate layers;

a spiral-shaped coil conductor that includes a plurality of discontinuous rectangle-shaped conductors disposed on respective layers of the plurality of stacked substrate layers and a plurality of interlayer conductors that connect the rectangle-shaped conductors to each other, respectively;

a first external connection conductor and a second external connection conductor each disposed on an outer surface of the multilayer body;

a first connection conductor that electrically connects a first end of the coil conductor to the first external connection conductor; and a second connection conductor that electrically connects a second end of the coil conductor to the second external connection conductor, wherein the first connection conductor comprises a first single linear routing conductor disposed on one of the plurality of stacked substrate layers above an uppermost layer of the coil conductor, a first interlayer conductor that connects the first single linear routing conductor to a rectangle-shaped conductor of an uppermost layer of the coil conductor, and a second interlayer conductor that connects the first single linear routing conductor to the first external connection conductor, wherein the substrate layer on which the first single linear routing conductor is disposed has a thickness greater than a thickness of a respective layer between two adjacent discontinuous rectangle-shaped conductors of the spiral-shaped coil conductor.

11. The multilayer inductor according to claim 10, wherein a distance between the rectangle-shaped conductor of the uppermost layer of the coil conductor and the routing conductor is greater than a distance between an outer peripheral edge of the coil conductor and a side surface of the multilayer body.

12. The multilayer inductor according to claim 10, wherein the second interlayer conductor is disposed in a direction orthogonal to the stacked substrate layers and inside the rectangle-shaped conductors of the coil conductor.

13. The multilayer inductor according to claim 10, wherein the first connection conductor further comprises a second linear routing conductor disposed on a lowermost layer of the plurality of stacked substrate layers, which electrically connects the second interlayer conductor to the first external connection conductor.

14. The multilayer inductor according to claim 13, wherein a distance between the coil conductor and the second linear routing conductor is greater than a distance between an outer peripheral edge of the coil conductor and a side surface of the multilayer body.

15. The multilayer inductor according to claim 10, wherein at least one of the plurality of stacked substrate layers disposed between the coil conductor and the outer surface of the multilayer body comprises a dummy pattern formed in a region inside the rectangle-shaped conductor, when the multilayer body is viewed in a direction orthogonal to the plurality of stacked substrate layers.

16. The multilayer inductor according to claim 10, wherein the plurality of stacked substrate layers are magnetic layers.

17. A power supply circuit module comprising the multilayer inductor according to claim 16, wherein the multilayer inductor is configured to operate as a converter inductor.

18. A multilayer inductor comprising:

a multilayer body having a top and a bottom surface and a plurality of stacked substrate layers disposed therebetween;

a first external connection conductor and a second external connection conductor each disposed on the bottom surface of the multilayer body;

a coil conductor that includes a plurality of loop-like line-shaped conductors each disposed on one of the plurality of stacked substrate layers and a plurality of interlayer conductors that connect the loop-like line-shaped conductors to each other, respectively;

a first connection conductor that electrically connects a first end portion of the coil conductor to the first external connection conductor; and a second connection conductor that electrically connects a second end portion of the coil conductor to the second external connection conductor, wherein the first connection conductor includes:

a first linear routing conductor disposed on a substrate layer between the coil conductor and a top surface of the multilayer body, the first linear routing conductor extending from an outer periphery towards a center of the substrate layer on which the first linear routing conductor is disposed, a first interlayer conductor that connects the first routing conductor to a loop-like line-shaped conductor of an uppermost layer of the coil conductor, a second interlayer conductor connected to the first linear routing conductor and that is disposed in a direction orthogonal to the stacked substrate layers and inside the loop-like line-shaped conductors of the coil conductor, the second interlayer conductor having a height greater than a total thickness of the substrate layers on which the plurality of loop-like line-shaped conductors are disposed, respectively, and a second linear routing conductor disposed on a bottom surface of the plurality of stacked substrate layers and that electrically connects the second interlayer conductor to the first external connection conductor, wherein the substrate layer between the coil conductor and the first linear routing conductor has a thickness greater than a thickness of the substrate layer between two adjacent loop-like line-shaped conductors of the coil conductor.

19. The multilayer inductor according to claim 10, wherein the one substrate layer above the uppermost layer of the coil conductor has a thickness greater than a thickness of at least a portion of the substrate layers of the coil conductor.

20. The multilayer inductor according to claim 1, wherein the first connection conductor further includes a second linear routing conductor disposed on a bottom surface of the plurality of stacked substrate layers, the second linear routing conductor electrically connecting the second interlayer conductor to the first external connection conductor.

21. The multilayer inductor according to claim 10, wherein the first connection conductor further includes a second linear routing conductor disposed on a lowermost layer of the coil conductor, the second linear routing conductor electrically connecting the second interlayer conductor to the first external connection conductor.

* * * * *